US006007125A

United States Patent [19]

Merel

[11] Patent Number: 6,007,125

[45] Date of Patent: Dec. 28, 1999

[54] DEVICE FOR TURNING OVER HEAVY AND/OR BULKY LOADS

[75] Inventor: Jerome Merel, Albigny sur Saone, France

[73] Assignee: Topal Industries S.A., Saint-Priest, France

[21] Appl. No.: 09/100,559

[22] Filed: Jun. 19, 1998

[30] Foreign Application Priority Data

Mar. 23, 1998 [EP] European Pat. Off. ..... 98440058

[51] Int. Cl.[6] ..... B66C 1/12

[52] U.S. Cl. ..... 294/81.4; 294/74; 414/756

[58] Field of Search ..... 294/67.3, 67.5, 294/81.1, 81.2, 81.3, 81.4, 81.55, 86.41, 74; 414/756

[56] References Cited

U.S. PATENT DOCUMENTS

| | | | |
|---|---|---|---|
| 1,513,018 | 10/1924 | Tracy | 294/81.55 |
| 3,545,629 | 12/1970 | Kaplan et al. | 414/756 |
| 3,662,903 | 5/1972 | Mazzone | 414/756 |
| 3,677,418 | 7/1972 | Franzen | 414/756 |
| 3,809,422 | 5/1974 | Schlough | 294/81.4 |
| 3,841,498 | 10/1974 | Heidrich et al. | 414/756 |
| 4,114,765 | 9/1978 | Kojima | 414/756 |

FOREIGN PATENT DOCUMENTS

| | | | |
|---|---|---|---|
| 4-189297 | 7/1992 | Japan | 294/81.4 |

*Primary Examiner*—Dean J. Kramer
*Attorney, Agent, or Firm*—Ostrolenk, Faber, Gerb & Soffen, LLP

[57] ABSTRACT

A device (1) for turning over heavy and/or bulky loads works by suspending the load to be turned over in two straps or the like, arranged as loops, and driving these straps in order to pivot the load. The device (1) is constructed of a body (2) that has a shackle (20) for suspending device (1) from the hook of lifting gear, and through which there passes a tube (3). At each end (30) of tube (3) there is a drive pulley (4) and an individual strap (5) arranged as a loop passes over each pulley (4). It is possible for tube (3) to be rotated by motor (24) contained within body (2) and connected to tube (3) by transmission chain (31). The distance between drive pulleys (4) is a function of the length of tube (3).

12 Claims, 4 Drawing Sheets

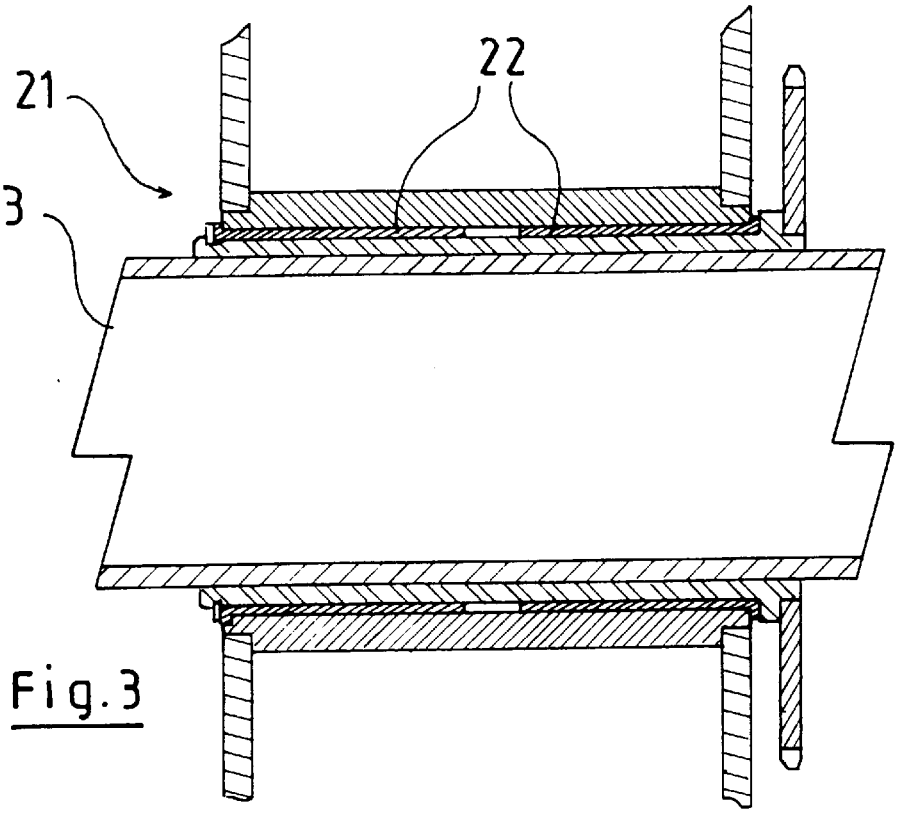
Fig.3
Fig.5
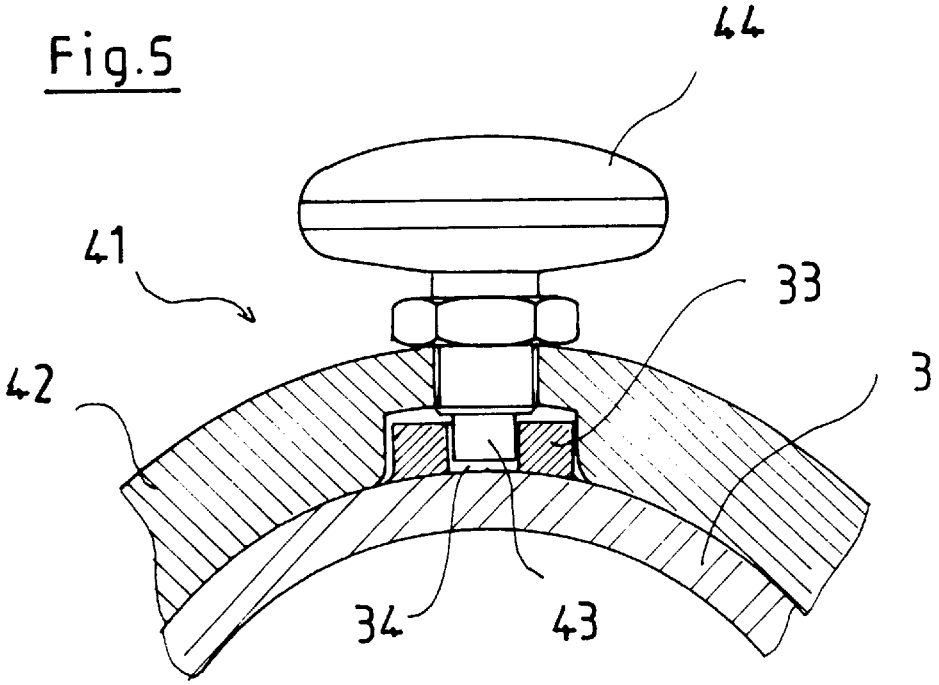

DEVICE FOR TURNING OVER HEAVY AND/ OR BULKY LOADS

The subject of the present invention is a device for turning over heavy and/or bulky loads.

Devices for turning over heavy and/or bulky loads which work by suspending the load to be turned over in two straps or the like, arranged as loops, then in driving these straps in order to pivot said load are already known.

Such a turning-over device thus comprises a body which has means for suspending it from a hook and which contains a motor which simultaneously rotates two drive pulleys, placed one on each side of said body, and over each of which a strap passes.

In order to ensure perfect stability of the load that is to be turned over, the distance between the drive pulleys must be in proportion with the length of said load.

Thus, there are various designs of turning-over device which differ, apart from in terms of the power of the motor and the robustness of their design, essentially in the distance separating the two drive pulleys.

Now, the design of the existing turning-over devices does not allow for easy manufacture of appliances with different separations.

This is because these devices comprise two shafts mounted in bearings and placed one on each side of the motor, coaxial with this motor, one end of each said bearings being connected to said motor, while the other carries a drive pulley.

To change the distance between the drive pulleys therefore requires the production of special-purpose shafts, and this leads to an additional cost.

Furthermore, such a device, specially the framework of the body, needs to be a very robust and therefore heavy design, in order to guarantee perfect alignment of the bearings and of the motor.

Furthermore, a turning-over device of the conventional type allows only objects whose length lies within two limiting values, but depends on the distance between the drive pulleys, to be turned over. Now, it may often be necessary to turn over objects of very different lengths, something which can then be achieved only by using another turning-over device with an appropriate distance between pulleys.

Nonetheless, turning-over devices are known in which the pulleys are each carried by a bearing that can move along a beam, while said pulleys are driven via two shafts rotated by a motor secured to said beam.

These devices are, however, more complicated to manufacture, something which is not conducive to greater standardization.

The object of the present invention is to propose a device for turning over heavy and/or bulky loads, that makes it possible to overcome these various drawbacks.

The device for turning over a load according to the invention, is essentially one which comprises a body that has means for suspending it from the hook of lifting gear, and through which there passes a tube which at each of its ends carries a drive pulley over which there passes a strap arranged as a loop, it being possible for said tube to be rotated by a motor contained in said body and connected to said tube by transmission means, the distance between the drive pulleys being a function of the length of the tube.

The turning-over device according to the invention is therefore of a simple design, the distance separating the two drive pulleys can be changed merely by altering the length of the tube, which is of a very much lower cost than the existing turning-over devices.

According to an additional feature of the device according to the invention, the tube is mounted so that it can pivot in a bearing via anti-friction means.

According to an alternative form of the device according to the invention, the drive pulleys are mounted so that they can be shifted along the tube, with the possibility of immobilizing them in the longitudinal direction, and preventing them from rotating.

In this configuration, it is possible to alter the distance separating the two drive pulleys to suit the dimensions of the load that is to be turned over.

According to another additional feature of the device according to the invention, it comprises a skew detector connected to the motor-control means, capable of stopping this motor if the assembly becomes inclined by more than a predefined value that is determined on the basis of the equilibrium position.

The advantages and features of the present invention will emerge more clearly from the description which follows and which refers to the appended drawing, which depicts one nonlimiting embodiment.

In the appended drawing:

FIG. 3 depicts a part view in section on XX' of FIG. 2.

FIG. 5 depicts a part view in cross-section of the same alternative form of the device according to the invention.

Figure 1:
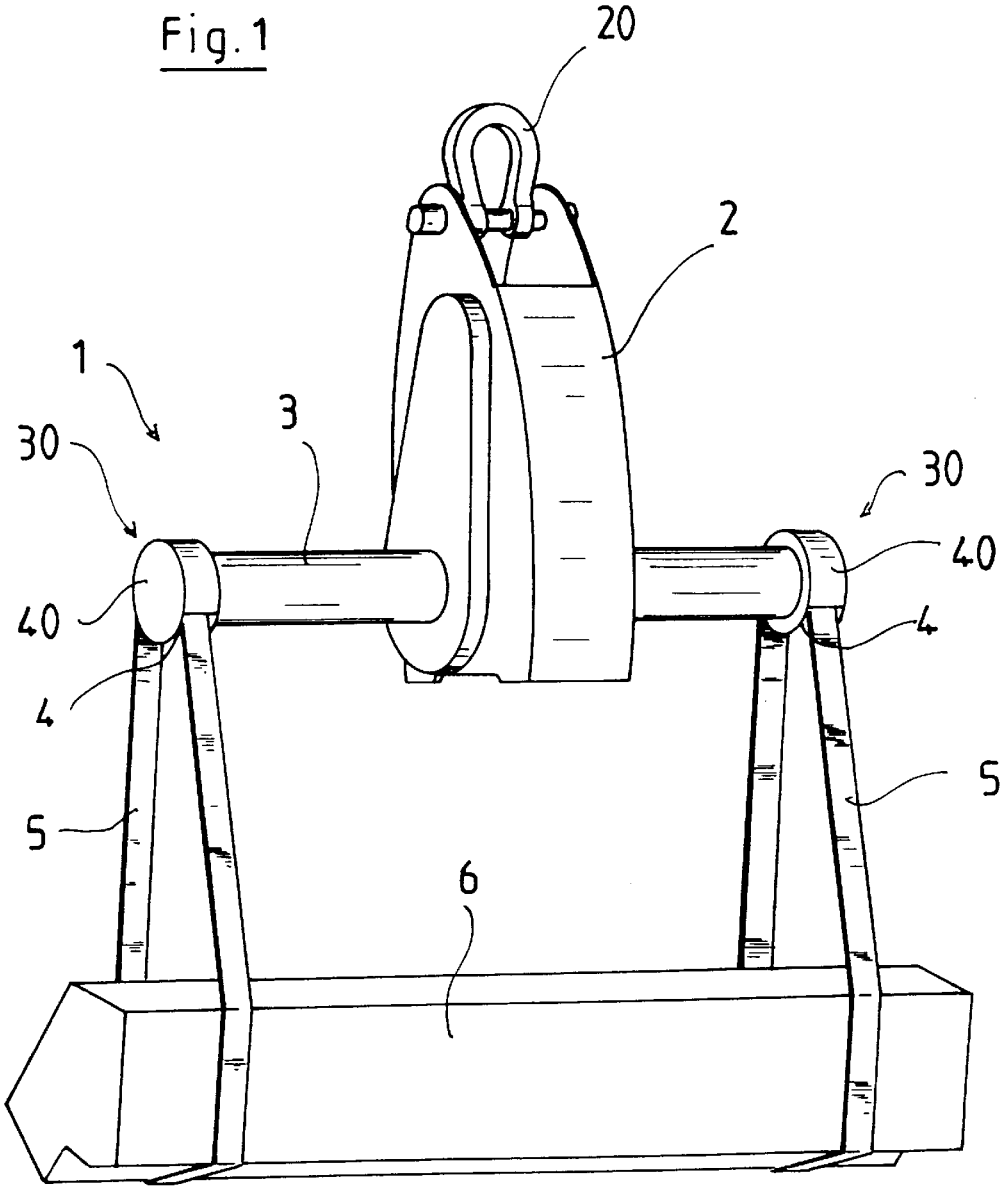
FIG. 1 depicts a view in perspective of a device for turning over a load according to the invention.

If reference is made to FIG. 1, it is possible to see that a turning-over device 1 according to the invention comprises a body 2 equipped, at the top, with a suspension means, in this case a lifting shackle 20, and through the lower part of which a tube 3 passes transversely.

The ends 30 of the tube 3 are each fitted with a drive pulley 4 covered by a casing 40, and through which there passes a strap 5 arranged as a loop, while a load 6 rests in the straps 5 with a view to being turned over.

Figure 2:
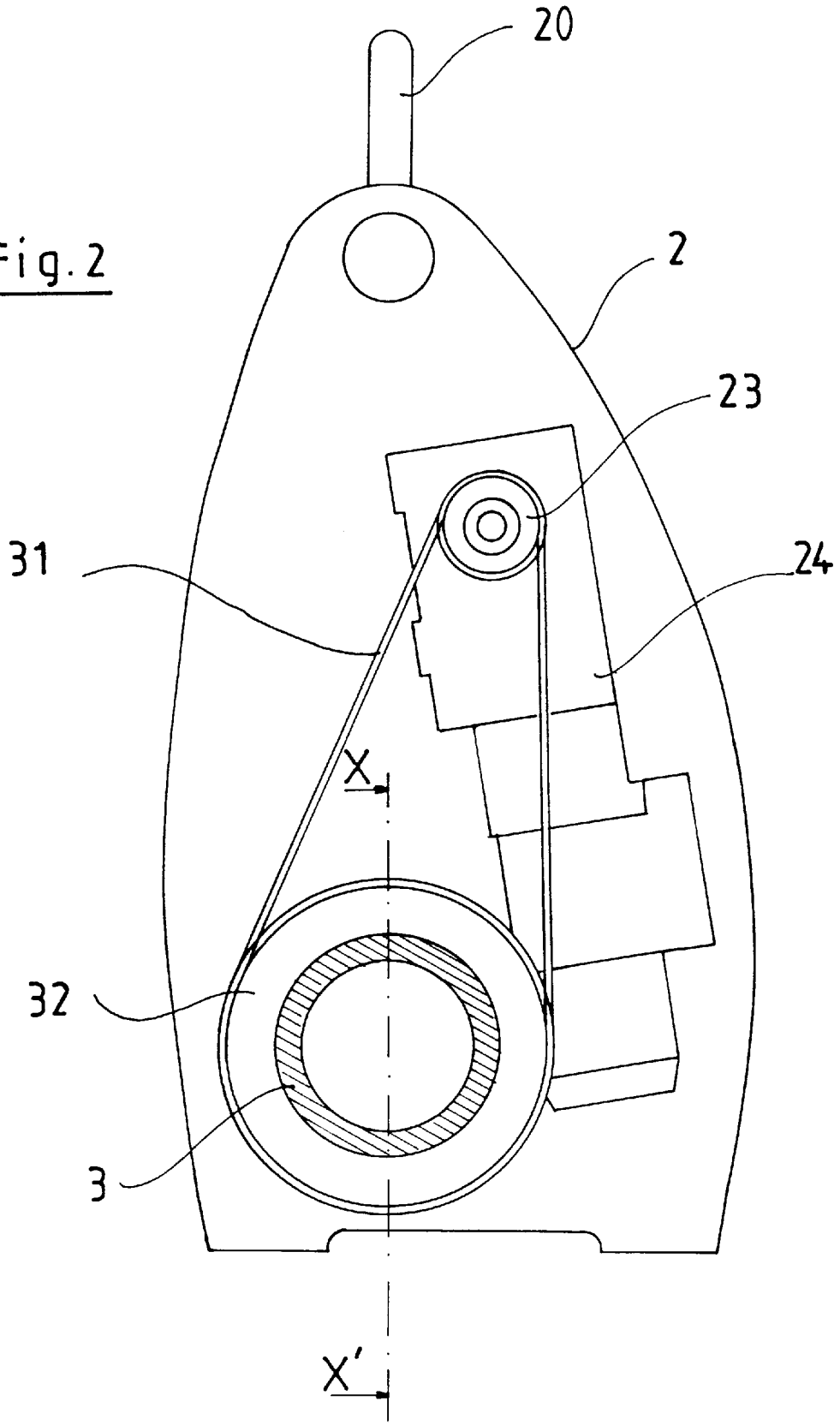
FIG. 2 depicts a side view of part of the same device.

If reference is now made to FIGS. 2 and 3, it is possible to see that, in the body 2, the tube 3 is mounted so that it can pivot in a bearing 21 lined with anti-friction means which consist of two bushes 22 made of a polymer.

The use of polymer bushes has numerous advantageous over the rotational-guidance means used in existing turning-over devices, namely rolling bearings; firstly, they are less complicated to fit, secondly, they require no lubrication, and thirdly, they are lighter.

It will, however, be noted that for a turning-over device according to the invention that is intended for turning over very heavy loads, this device will need to be fitted with rolling bearings.

The tube 3 is rotated via a chain 31 which meshes with a chain wheel 32 keyed onto the tube 3, and with the pinion 23 of a braked gear motor unit 24.

The distance between the drive pulleys 4 can be altered simply by choosing the length of the tube 3, which simplifies manufacture.

Furthermore, the turning-over device according to the invention requires just one bearing, and its weight is less than that of an existing device of equivalent capacity.

Figure 4:
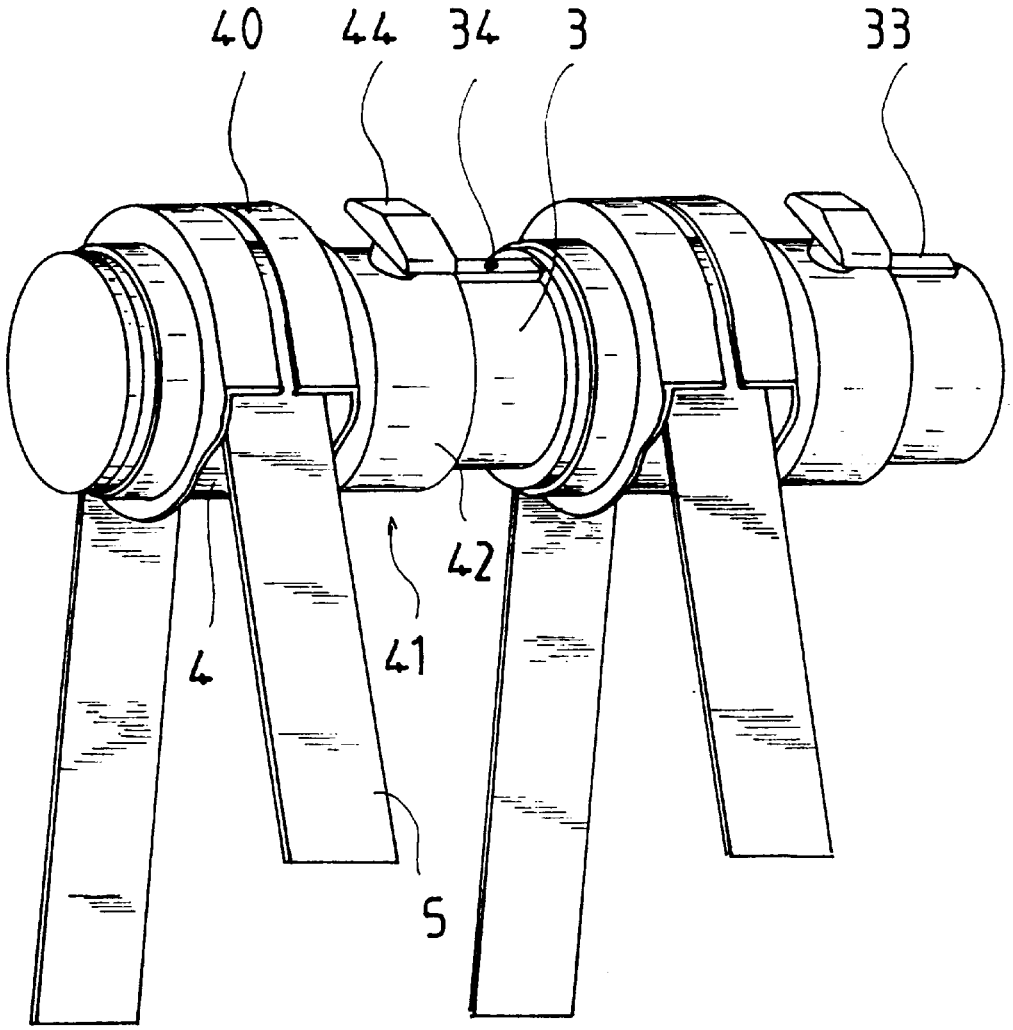
FIG. 4 depicts a part view in perspective of an alternative form of the same device.

If reference is now made to FIG. 4, it is possible to see an alternative form of the turning-over device according to the invention, making it possible to vary the distance between the drive pulleys 4, something that cannot be achieved in existing turning-over devices.

This figure shows two different positions of a drive pulley 4 on the tube 3.

The drive pulley 4 is immobilized in terms of rotation by means of a key 33 which extends longitudinally over each of the parts of the tube 3 that are outside the body 2, not visible, and which nonetheless allows the drive pulley 4 to be moved longitudinally.

Furthermore, the drive pulley 4 is equipped with a locking means 41, allowing it to be immobilized longitudinally along the tube 3.

In this embodiment, the locking means 41 comprises a ring 42 slipped over the tube 3 and secured to the drive pulley 4, and an indexing means, not visible.

If reference is also made to FIG. 5, which depicts a cross section of the locking means 41, it is possible to see that the key 33 has notches 34, just one of which is visible in the figure, which are uniformly spaced and intended to accommodate an indexing peg 43 which can move in radial translation in the ring 42, by screwing, for example, under the action of an operating means 44, and allowing the ring 42, and therefore the drive pulley 4 to be immobilized in the longitudinal direction along the tube 3.

This alternative version makes it possible, using one and the same turning-over device, for objects of very different lengths to be turned over.

The turning-over device according to the invention may be fitted with a known skew-detection means capable, if one side of the assembly or the other becomes too steeply inclined, and according to a predetermined value, of stopping the motor, thus preventing the turning-over operation from continuing.

I claim:

1. A device for turning over heavy and/or bulky loads which works by suspending a load to be turned over in first and second straps, arranged as loops, then in driving said straps in order to pivot said load, said device (1) including a body (2) that has a portion (20) for suspending said device (1) from a hook of lifting gear, a tube (3) passing through said body and having a length, said tube being supported entirely by said body along a central portion of said tube, an individual drive pulley (4) carried at each end (30) of said tube (3) and over which there passes an individual strap (5) arranged as a loop, the distance between said drive pulleys being a function of the length of said tube, said tube (3) being rotatable by a motor (24) mounted to said body (2), a transmission (32, 31, 23) connecting said motor to said tube (3).

2. The device as claimed in claim 1, wherein the tube (3) is mounted so that it can pivot in a bearing (21) via an anti-friction substance (22).

3. The device as claimed in claim 2, wherein the anti-friction substance comprises at least one bush (22) constructed of a polymer.

4. The device as claimed in claims 1, wherein the tube (3) is rotated by a chain (31) meshing with a chain wheel (32) keyed onto said tube (3) and a pinion (23) of a braked gear motor unit (24).

5. The device as claimed in claim 4, which comprises a skew detector for stopping said motor unit (24) automatically if the load that is being turned becomes inclined by more that a predefined value that is determined on the basis of an equilibrium position.

6. The device as claimed in claim 4, wherein the tube (3) is mounted so that it can pivot in a bearing (21) via an anti-friction substance (22).

7. The device as claimed in claims 1, wherein the drive pulleys (4) are mounted so that they can be shifted lengthwise along the tube (3), with the possibility of immobilizing said drive pulleys (4) in the longitudinal direction, and preventing them from rotating.

8. The device as claimed in claim 7, wherein associated with each of said drive pulleys (4) there is a set of parts on the tube (3) disposed outside the body (2) with each of said sets of parts comprising a key (33) for allowing rotation of a drive pulley (4) to be prevented, while at the same time allowing this pulley (4) to be shifted longitudinally.

9. The device as claimed in claims 8, wherein immobilization of said drive pulley (4) in the longitudinal direction is achieved using an indexing peg (43) from said set of parts, said peg (43) being movable radially with respect to the tube (3) and being enterable into uniformly-spaced notches (34) that are in the key (33).

10. The device as claimed in claim 8, wherein the tube (3) is rotated by a chain (31) meshing with a chain wheel (32) keyed onto said tube (3) and a pinion (23) of a braked gear motor unit (24).

11. The device as claimed in claim 8, wherein immobilization of said drive pulley (4) in the longitudinal direction is achieved using an indexing peg (43) from said set of parts, said peg (43) being movable radially with respect to the tube (3) and being enterable into uniformly-spaced notches (34) that are in the key (33).

12. The device as claimed in claim 7, wherein the tube (3) is rotated by a chain (31) meshing with a chain wheel (32) keyed onto said tube (3) and a pinion (23) of a braked gear motor unit (24).

* * * * *